US011246386B1

(12) United States Patent
Williams

(10) Patent No.: US 11,246,386 B1
(45) Date of Patent: Feb. 15, 2022

(54) BODY JEWELRY

(71) Applicant: Laura D. Williams, Oak Ridge, TN (US)

(72) Inventor: Laura D. Williams, Oak Ridge, TN (US)

( * ) Notice: Subject to any disclaimer, the term of this patent is extended or adjusted under 35 U.S.C. 154(b) by 0 days.

(21) Appl. No.: 17/027,104

(22) Filed: Sep. 21, 2020

(51) Int. Cl.
*A44C 15/00* (2006.01)
*A44C 13/00* (2006.01)

(52) U.S. Cl.
CPC ..... *A44C 13/00* (2013.01); *A44C 15/0055* (2013.01)

(58) Field of Classification Search
CPC ..... A44C 11/00; A44C 13/00; A44C 15/0005; A44C 15/001; A44C 15/005; A44C 15/0055
USPC ..... D11/3; 63/4
See application file for complete search history.

(56) References Cited

U.S. PATENT DOCUMENTS

D534,453 S * 1/2007 Brown ..... D11/3
7,513,129 B1 * 4/2009 Mays ..... A44C 15/005 63/3.2
7,980,095 B1 * 7/2011 Masterson ..... A44C 11/002 63/41
9,894,965 B2 * 2/2018 Edmonston ..... A44C 15/005
D872,622 S * 1/2020 Hanson ..... D11/13
2006/0191291 A1 * 8/2006 White ..... A44C 15/0055 63/4
2019/0281932 A1 * 9/2019 Nam ..... A44C 5/20

FOREIGN PATENT DOCUMENTS

CA 2911898 A1 * 5/2017 ..... A44C 11/00

* cited by examiner

*Primary Examiner* — Jack W Lavinder
(74) *Attorney, Agent, or Firm* — Albert Bordas, P.A.

(57) ABSTRACT

Body jewelry, having a neck chain assembly with a neck chain, and a short chain; a torso chain assembly having first and second chest chains, and at least one chain; and a hip chain assembly having a hip chain, whereby the neck chain assembly is worn around a neck of a user, the torso chain assembly extends downwardly along a front torso of the user, and the hip chain assembly is worn around waist and/or hips of the user for facilitating adult activities of a sexual nature, including bondage to achieve a state or practice of being physically led, pulled, or restrained, as by being tied up or chained for sexual gratification.

9 Claims, 6 Drawing Sheets

BODY JEWELRY

BACKGROUND OF THE INVENTION

1. Field of the Invention

The present invention relates to jewelry, and more particularly, to jewelry for the body.

2. Description of the Related Art

Applicant is not aware of any body jewelry having the novel features of the present invention.

SUMMARY OF THE INVENTION

The present invention is body jewelry, comprising a neck chain assembly having a neck chain, and a short chain; a torso chain assembly having first and second chest chains, and at least one chain; and a hip chain assembly having a hip chain, whereby the neck chain assembly is worn around a neck of a user, the torso chain assembly extends downwardly along a front torso of the user, and the hip chain assembly is worn around waist and/or hips of the user.

The neck chain assembly further comprises at least one neck chain clasp and chain connectors. The chain connectors are secured onto the neck chain at different positions. The short chain in connected to the neck chain extending from one of the chain connectors. The torso chain assembly further comprises at least one torso chain connectors and a torso chain main connector. The torso chain assembly is connected to the neck chain assembly. The first and second chest chains extend from the neck chain to the torso chain main connector defining a V-shape. The at least one chain extends from the torso chain main connector. The hip chain assembly further comprises at least one hip chain internal clasp, at least one external connection clasp, and hip chain connectors secured at different positions onto the hip chain. The torso chain assembly is detachably connected to the hip chain assembly, whereby the at least one chain connects to the hip chain at the at least one external connection clasp.

Further comprising a breast chain assembly extending from the neck chain assembly. The breast chain assembly comprises at least one breast chain, breast chain clasps, and at least one rod.

Further comprising a back chain assembly detachably connected to the neck chain assembly and to the hip chain assembly. The back chain assembly comprises at least one back chain, at least one back chain clasp, and at least one back chain connector.

Further comprising a leg chain assembly detachably connected to the hip chain assembly. The leg chain assembly comprises multi-layered leg chains and leg chain clasps. Further comprising at least one chain extending from the hip chain along thighs of the user.

The neck chain assembly, the torso chain assembly, the hip chain assembly, the back chain assembly, the breast chain assembly, and the leg chain assembly further comprise charms secured thereon. The chain connectors, the at least one torso chain connectors, the torso chain main connector, the hip chain connectors, and the back chain connectors are of geometric shapes. The chain connectors, the at least one torso chain connectors, the hip chain connectors, and the back chain connectors connect the charms. Special designed connectors, as the charms, are intended to be placed anywhere optionally.

It is therefore one of the main objects of the present invention to provide body jewelry.

It is another object of this invention to provide body jewelry worn by a user for enjoyment between lovers including supporting and/or restraining a person in a position conducive to engaging in sexual activities.

It is another object of this invention to provide entertainment body jewelry for facilitating adult activities of a sexual nature, including bondage to achieve a state or practice of being physically led, pulled, or restrained, as by being tied up or chained for sexual gratification.

It is another object of this invention to provide body jewelry that can be readily assembled and disassembled without the need of any special tools.

It is another object of this invention to provide body jewelry, which is of a durable and reliable construction.

It is yet another object of this invention to provide body jewelry that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
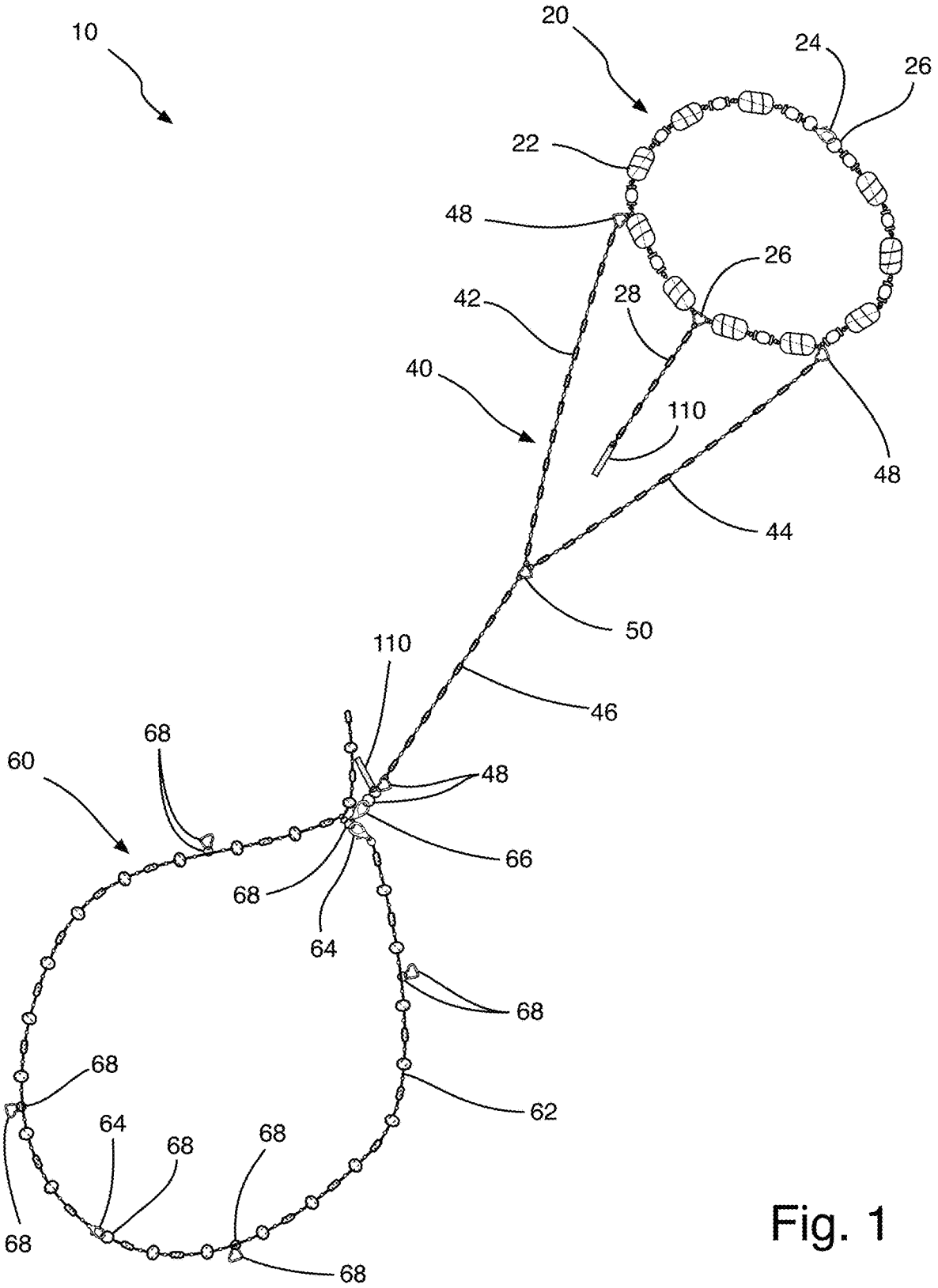
FIG. 1 represents an isometric view of the present invention.

Referring now to the drawings, the present invention is body jewelry, and is generally referred to with numeral 10. It can be observed that it basically includes neck chain assembly 20, torso chain assembly 40, and hip chain assembly 60.

Present invention 10 is an optional adult entertainment, or for everyday use, body jewelry, worn by a user for enjoyment between lovers including supporting and/or restraining a person in a position conducive to engaging in sexual activities. More particularly, present invention 10 relates to adult entertainment body jewelry for facilitating adult activities of a sexual nature, including bondage to achieve a state or practice of being physically led, pulled, or restrained, as by being tied up or chained for sexual gratification.

As seen in FIG. 1, neck chain assembly 20 comprises neck chain 22 and short chain 28. Torso chain assembly 40 comprises first and second chest chains 42 and 44, and at least one chain 46. Hip chain assembly 60 comprises hip chain 62. Torso chain assembly 40 is connected to neck chain assembly 20. In addition, torso chain assembly 40 is detachably connected to hip chain assembly 60. Hip chain assembly 60 further comprises hip chain connectors 68, which are secured at different positions of hip chain 62. It is noted that depending on comfort or preference, hip chain assembly 60 can be worn around the hip or waist, or at about the belly of the user.

Neck chain assembly 20, torso chain assembly 40, and hip chain assembly 60 further comprise charms 110 secured at different positions. In a preferred embodiment, charms 110 may have respective connectors and may be of any geometric shape or configuration. In addition, charms 110 are collectables, and represent levels of sexual commitment, fantasies, sexual experiences, partners, bondage, and/or to inform of preferences of being physically led, pulled, or restrained, as by being tied up or chained for sexual gratification.

Figure 2:
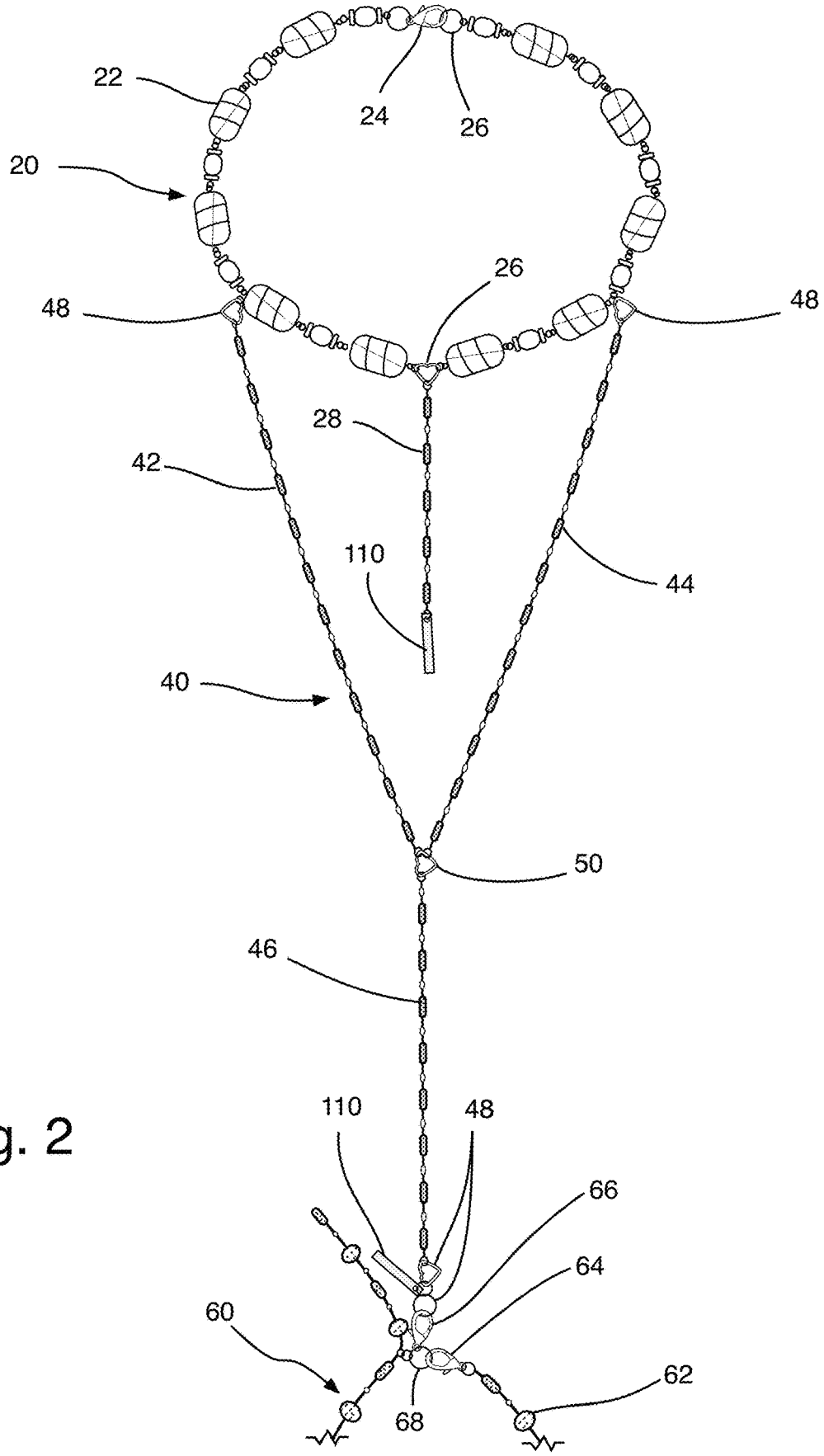
FIG. 2 is an enlarged view of a neck chain assembly and torso chain assembly showing a portion of a preferred embodiment as seen in FIG. 1.

As seen in FIG. 2, neck chain assembly 20 further comprises at least one neck chain clasp 24 and chain connectors 26. Chain connectors 26 are secured onto neck chain 22 at different positions. Short chain 28 is secured onto neck chain 22, extending from one of chain connectors 26. Short chain 28 may comprises charm 110. Multiple chains can be placed here too.

Torso chain assembly 40 further comprises at least one torso chain connectors 48 and torso chain main connector 50. In a preferred embodiment, first and second chest chains 42 and 44 extend from neck chain 22 to torso chain main connector 50 defining a V shape. At least one chain 46 extends from torso chain main connector 50. In a preferred embodiment, first and second chest chains 42 and 44 connect to neck chain 22 with at least one torso chain connectors 48 or with chain connectors 26 secured onto neck chain 22. At least one chain 46 may comprises at least one charm 110. Multiple chains can be placed on this unit as well.

Hip chain assembly 60 further comprises at least one hip chain internal clasp 64 and at least one external connection clasp 66. At least one chain 46 connects to hip chain 62 with external connection clasp 66. Hip chain 62 may also comprise at least one charm 110.

Chain connectors 26, at least one torso chain connectors 48, torso chain main connector 50, and hip chain connectors 68 may be of any geometric shape. Chain connectors 26, at least one torso chain connectors 48, torso chain main connector 50, and hip chain connectors 68 may secure accessory chains AC, seen in FIG. 6, and/or charms 110. In a preferred embodiment, chain connectors 26, at least one torso chain connectors 48, and hip chain connectors 68 may have respective clasps, to allow accessory chains AC, seen in FIG. 6, and/or charms 110 to be secured and/or removed when desired.

Figure 3:
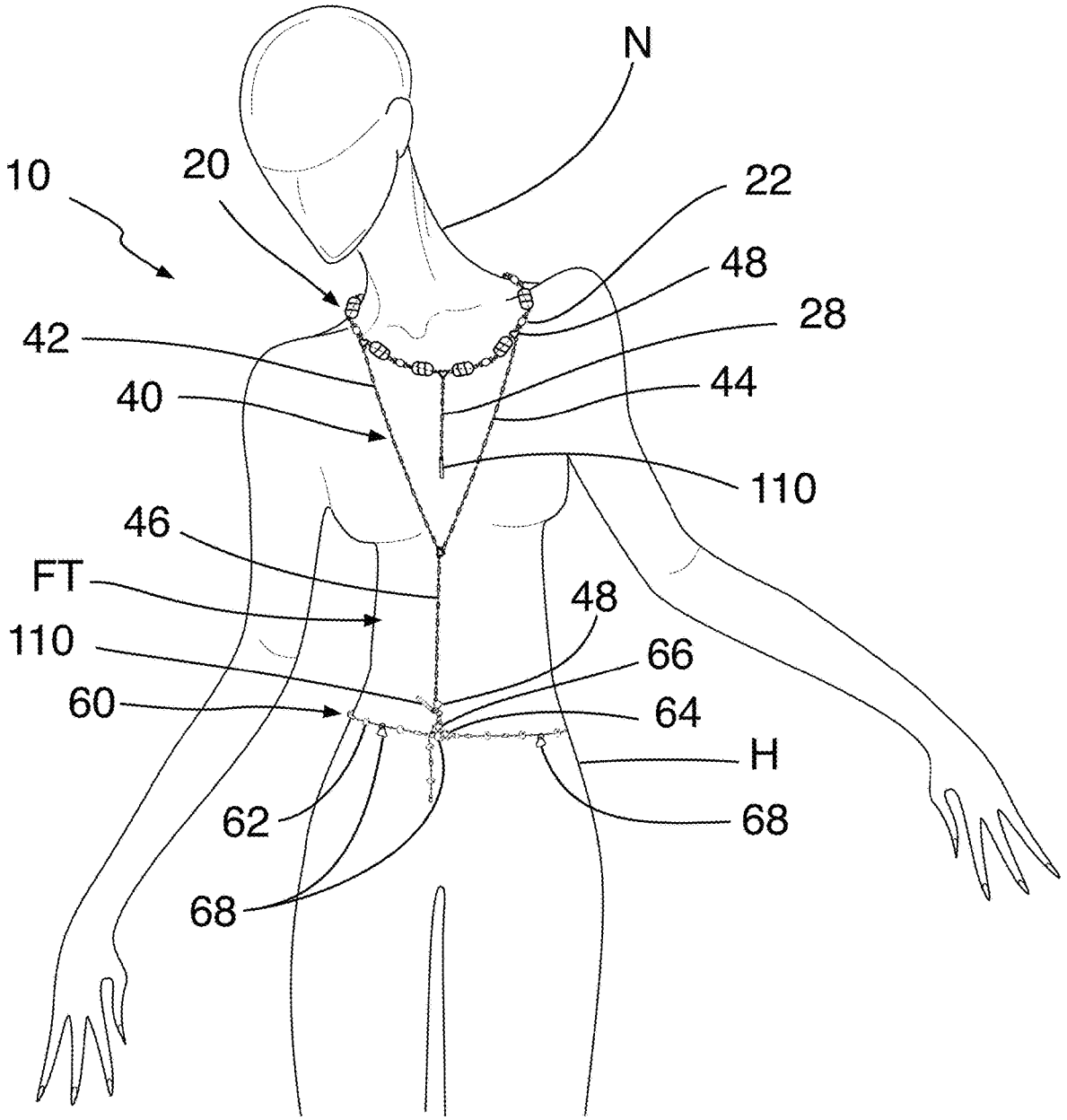
FIG. 3 is a first front isometric view of a user wearing the present invention.

As seen in FIG. 3, neck chain assembly 20 is worn around neck N of a user, torso chain assembly 40 extends downwardly along front torso FT, and hip chain assembly 60 is worn around waist and/or hips H.

Figure 4:
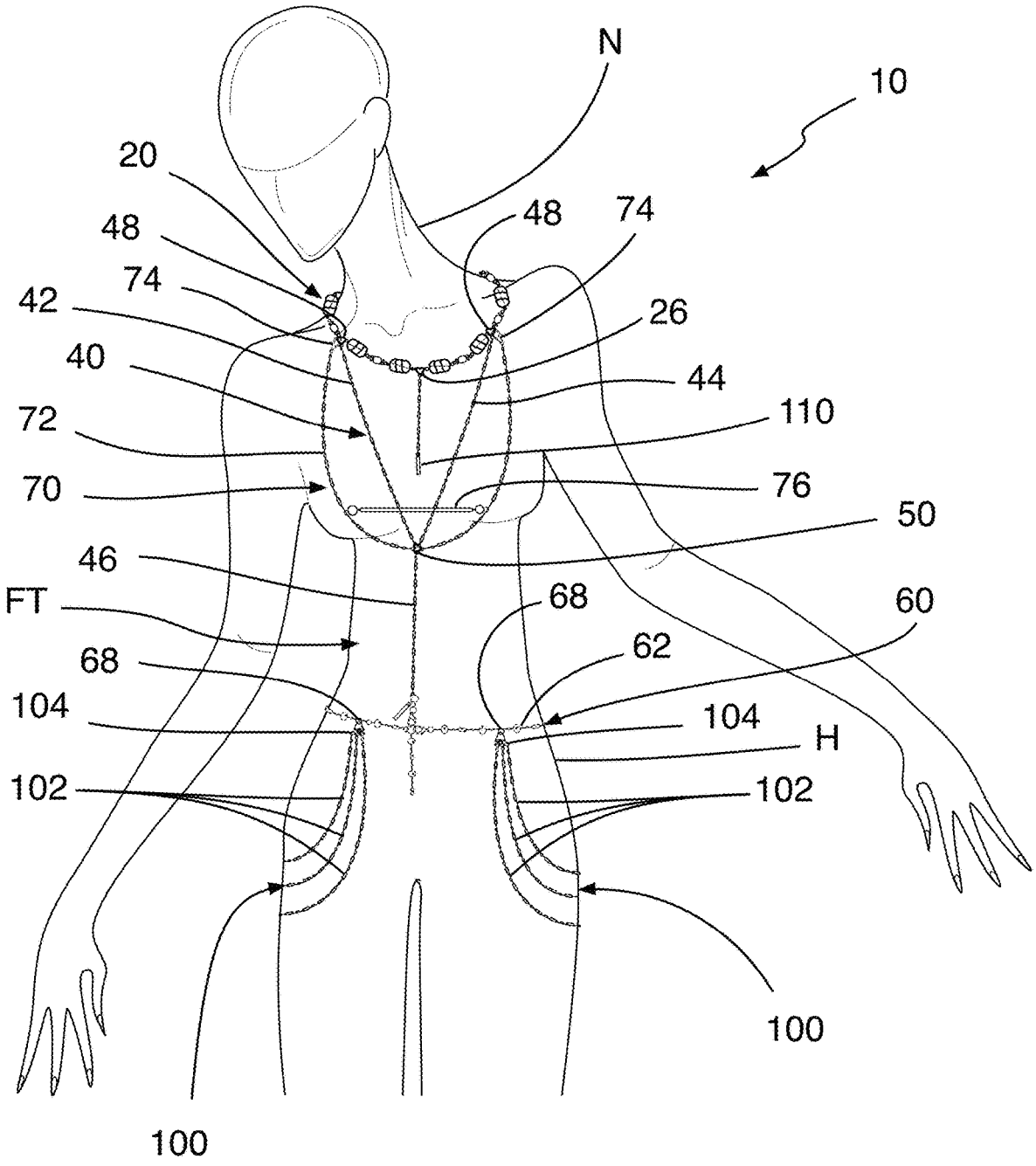
FIG. 4 is a second front isometric view of the user wearing the present invention with accessories including a breast chain assembly and a leg chain assembly.

As seen in FIG. 4, present invention 10 comprises accessories including at least one breast chain assembly 70 and leg chain assembly 100. Breast chain assembly 70 extends from neck chain assembly 20. Breast chain assembly 70 comprises at least one breast chain 72, breast chain clasps 74, and at least one rod 76. At least one rod 76 is stiff to keep at least one breast chain 72 separated. Breast chain assembly 70 is detachably connected to neck chain assembly 20. At least one breast chain 72 will comprise of multiple geometric shapes and in different configurations.

Leg chain assembly 100 is detachably connected to hip chain assembly 60. Leg chain assembly 100 comprises multi-layered leg chains 102 and leg chain clasps 104. Multi-layered leg chains 102 are connected to hip chain 62 with hip chain connectors 68. Leg chain assembly 100 may further comprise charms 110 secured at different positions.

Figure 5:
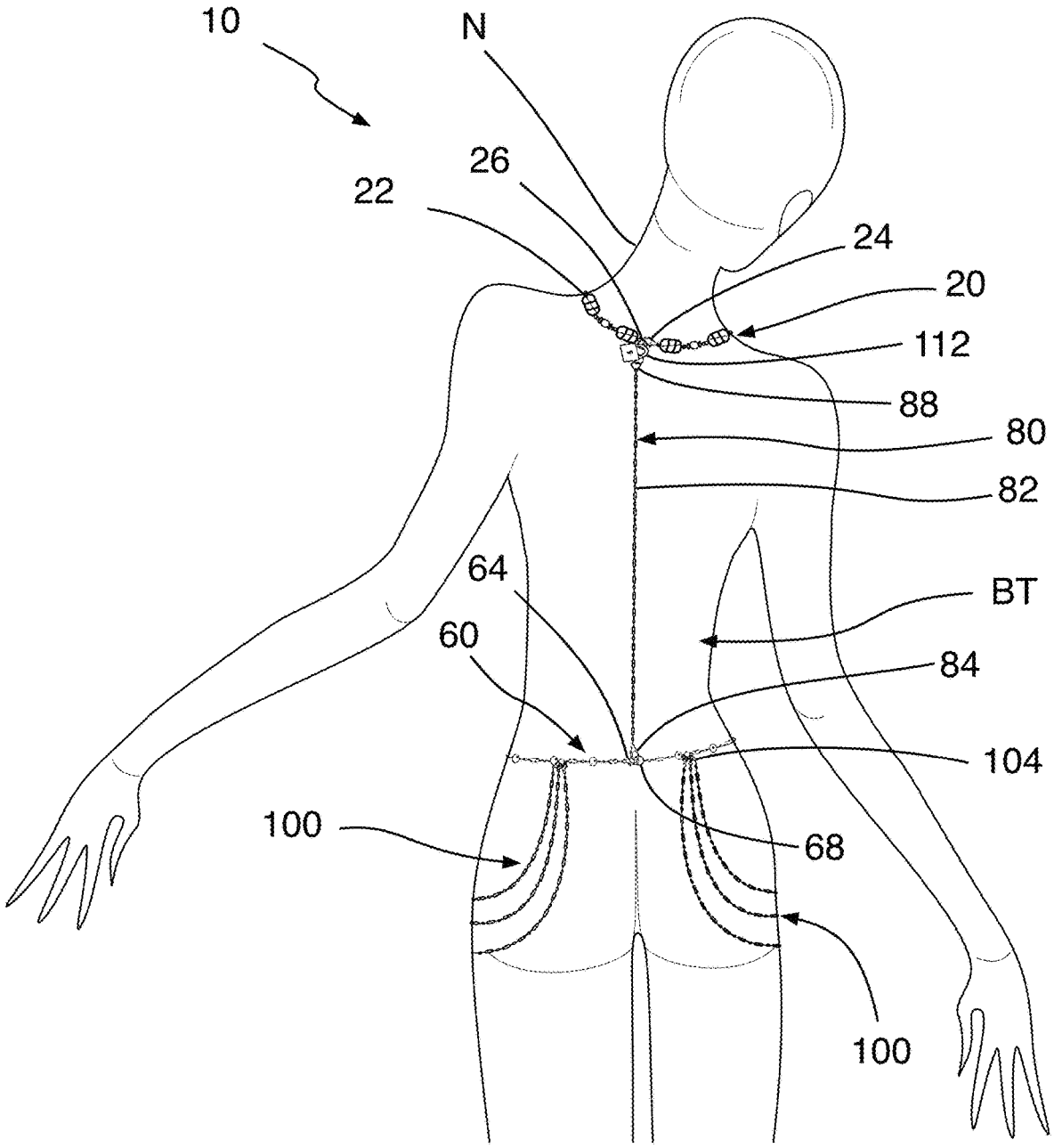
FIG. 5 is a rear isometric view of the user wearing the present invention with accessories including a back chain assembly and the leg chain assembly.

As seen in FIG. 5, present invention 10 comprises additional accessories including back chain assembly 80. Back chain assembly 80 extends along back torso BT from neck chain assembly 20 to hip chain assembly 60. Back chain assembly 80 is detachably connected to neck chain assembly 20 and to hip chain assembly 60. Back chain assembly 80 comprises at least one back chain 82, at least one back chain clasp 84, and at least one back chain connector 88. Back chain assembly 80 may also comprise charms 110. Back chain connectors 88 may be of any geometric shape and may also secure charms 110.

Present invention 10 further comprises accessory lock 112. Lock 112 may be secured onto any part of present invention 10. In one embodiment, lock 112 may replace chain connector 26, which connects neck chain 22, torso chain 46 and at least one back chain 82. Lock 112 is meant to be unlocked by a lover/partner with either a charm 110, or a key, not illustrated, as a symbol of acceptance from the user of present invention 10. The charm 110 and/or the key can be worn by the lover/partner on their person, as to allow to be attached to their neck chain 22, if they have one, bracelets or something symbolic between the lovers. When the user of the present invention 10 is ready to "unlock their higher passion" with their lover, the lover will use the charm 110 and/or the key to unlock at least one back chain 82, or torso chain assembly 40 as an example if mounted onto front torso FT side.

Figure 6:
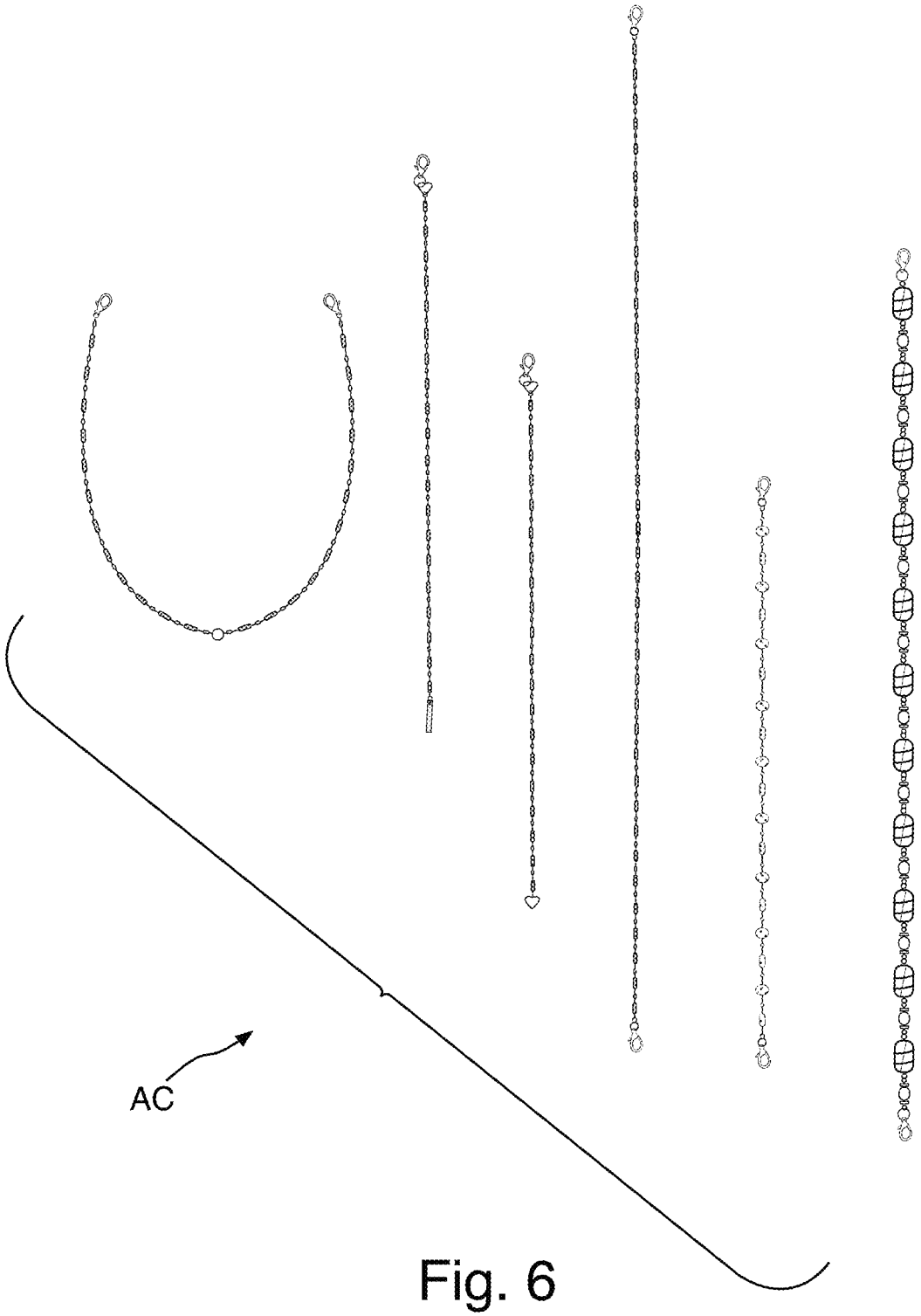
FIG. 6 is an isometric view of present invention accessory chains.

As seen in FIG. 6, present invention 10 comprises additional accessories including a plurality of accessory chains AC of different length and shapes. As an example, an accessory chain AC may extend from hip chain 62, seen in FIG. 1, along the user's thighs.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. Body jewelry, comprising:

A) a neck chain assembly having a neck chain, and a short chain, said neck chain assembly further comprises at least one neck chain clasp and chain connectors, said short chain is connected to said neck chain by one of said chain connectors, said short chain thus extending from said neck chain, whereby said neck chain assembly is detachably worn around a neck of a user and secured by said at least one neck chain clasp and chain connectors;

B) a torso chain assembly having first and second chest chains, and at least one chain, said torso chain assembly further comprises at least one torso chain connector and a torso chain main connector, said torso chain assembly is connected to said neck chain assembly, whereby said first and second chest chains are connected to said neck chain by said at least one torso chain connector, said first and second chest chains extend from said neck chain to said torso chain main connector defining a V-shape, said at least one chain extends from said torso chain main connector, whereby said torso chain assembly extends downwardly along a front torso of said user; and C) a hip chain assembly having a hip chain, at least one hip chain internal clasp, and at least one external connection clasp, said torso chain assembly is detachably connected to said hip chain assembly, whereby said at least one chain connects to said hip chain at said at least one external connection clasp, said hip chain assembly is detachably worn around a waist or hips of said user and secured with said at least one hip chain internal clasp.

2. The body jewelry set forth in claim 1, further characterized in that said chain connectors are secured to said neck chain at different positions.

3. The body jewelry set forth in claim 1, further characterized in that said hip chain assembly further comprises hip chain connectors secured at different positions to said hip chain.

4. The body jewelry set forth in claim 3, further comprising a breast chain assembly extending from said neck chain assembly, said breast chain assembly comprises at least one breast chain, breast chain clasps, and at least one rod, said at least one breast chain being connected to said neck chain assembly by said breast chain clasps, and said at least one breast chain being connected to said at least one chain by said torso chain main connector, said at least one rod keeps said at least one breast chain separated.

5. The body jewelry set forth in claim 4, further comprising a back chain assembly comprising at least one back chain, at least one back chain clasp, and at least one back chain connector, said at least one back chain being detachably connected to the back of said neck chain assembly with said at least one back chain connector and to said hip chain assembly with said at least one back chain clasp, whereby said at least one back chain runs along the back of said user.

6. The body jewelry set forth in claim 5, further comprising a leg chain assembly having multi-layered leg chains and leg chain clasps, said leg chain assembly being detachably connected to the front and back of said hip chain assembly by said leg chain clasps, said multi-layered leg chains extending from said hip chain along the thighs of said user.

7. The body jewelry set forth in claim 6, further characterized in that said neck chain assembly, said torso chain assembly, said hip chain assembly, said back chain assembly, said breast chain assembly, and said leg chain assembly further comprise charms secured thereto.

8. The body jewelry set forth in claim 7, further characterized in that said chain connectors, said at least one torso chain connectors, said hip chain connectors, and said back chain connectors connect said charms, each further comprising a lock.

9. The body jewelry set forth in claim 5, further characterized in that said chain connectors, said at least one torso chain connectors, said torso chain main connector, said hip chain connectors, and said back chain connectors are of geometric shapes.

* * * * *